United States Patent [19]

Mitter

[11] 3,992,994

[45] Nov. 23, 1976

[54] SCREEN PRINTER WITH CLEANING MEANS AND MEANS TO CONTROL RUNOFF

[75] Inventor: Mathias Mitter, Verl, Germany

[73] Assignee: Mitter & Co., Schloss Holte, Germany

[22] Filed: Jan. 7, 1975

[21] Appl. No.: 537,995

[30] Foreign Application Priority Data

Jan. 8, 1974 Germany ..... 2400728

[52] U.S. Cl. ..... 101/425; 101/116; 101/118; 198/820; 198/821

[51] Int. Cl.[2] ..... B41F 35/00; B41F 15/18; B45G 15/40; B45G 15/62

[58] Field of Search ..... 101/115, 116, 118, 123, 101/124, 126, 425; 198/191, 193, 201, 204, 229, 202, 181, 182, 137

[56] References Cited

UNITED STATES PATENTS

| | | | |
|---|---|---|---|
| 434,693 | 8/1890 | Woodbury | 198/201 |
| 2,052,748 | 9/1936 | Bowers | 198/181 X |
| 2,105,889 | 1/1938 | Madeira | 198/204 |
| 2,377,089 | 5/1945 | Lundbye | 101/425 X |
| 3,313,232 | 4/1967 | VanDerWimden | 101/118 |
| 3,658,003 | 4/1972 | Johnson | 101/425 X |
| 3,664,149 | 5/1972 | Garland et al. | 198/193 X |

*Primary Examiner*—Edgar S. Burr
*Assistant Examiner*—R. E. Suter
*Attorney, Agent, or Firm*—Michael J. Striker

[57] ABSTRACT

A printing machine has a printing station, certain components of which require intermittent cleaning due to fouling by the printing ink. An endless printing blanket is trained about a reversing roller that is spaced lengthwise of the machine from the printing station; the printing blanket has an upper run extending beneath the printing station and carrying the workpiece to be printed. The upper run is inclined downwardly with respect to the horizontal in direction from the printing station towards the reversing roller. A cleaning arrangement is provided for at times admitting a cleaning liquid into the printing station so as the clean the ink off the components, whereupon the liquid will run off the components onto the upper run of the printing blanket. Liquid-intercepting side members are provided which extend along the respective lateral edge portions of the upper run to the reversing roller and which prevent the liquid from running off the lateral edge portions into the machine.

28 Claims, 7 Drawing Figures

A
II
I
α
12
362
1
52
53
153
62
162
50
6
662
5
33
135
51
11
35
26
130
134
3
34
234
24
23
124
123
223
323
25
30
36
31
21
2
20
8
T

71
W
70
7
0
1
2
121
21
10
20
61
62
362
12
33
60
66

SCREEN PRINTER WITH CLEANING MEANS AND MEANS TO CONTROL RUNOFF

BACKGROUND OF THE INVENTION

The present invention relates generally to a printing machine, preferably (but not exclusively) to a screen printing machine. In particular, the invention relates to a printing machine having a cleaning function.

It is known that in printing machines certain components are frequently in need of cleaning, because printing ink tends to dry on them and foul them. This is true in particular in screen printing machines having rotary printing screens, but the problem is also encountered in all other types of printing machines.

Screen printing machines having rotary printing screens are known from the art, for example the Netherlands patent 125,119, and flat screen printing machines are known inter alia from French patent 1,230,051. These two patents provide an example of the type of cleaning that must be carried out, for example when a machine is to have dried ink removed from it, or when the machine is switched over from one ink color to another. It is then always necessary to remove the printing screen from the machine, clean it of the ink, and reinstall the screen in the machine before the machine can be operated again, for example with a different ink color. It is self-evident that this is time consuming, involving labor for the removal, cleaning and reinstallation of the printing screen, and also involving economic losses due to machine downtime while the screen or other component of the machine is being cleaned.

SUMMARY OF THE INVENTION

Accordingly, it is general object of this invention to overcome the disadvantages of the prior art.

More particularly, it is an object of the invention to provide an improved printing machine which avoids the aforementioned disadvantages.

The present invention is applicable to printing machines of all types, but is particularly suitable for screen printing machines.

A specific object of the invention is to provide an improved printing machine having a cleaning function, that is a printing machine in which it is possible to obtain the desired cleaning effect without having to remove any components for cleaning outside the machine.

In keeping with these objects, and with others which will become apparent hereafter, one feature of the invention resides in a printing machine, particularly in a screen printing machine, where the invention provides a combination comprising a printing station having components which require intermittent cleaning due to fouling by the printing ink, and an endless printing blanket trained about a reversing roller which is spaced lengthwise of the machine from the printing station and which has an upper run extending beneath the printing station and carrying the workpiece to be printed. The upper run is inclined downwardly with respect to the horizontal in direction from the printing station towards the reversing roller. Cleaning means is provided for at times admitting a cleaning liquid into the printing station to clean the components and run off onto the upper run of the printing blanket. Liquid intercepting means extends along the respective lateral edge portions of the upper run to the reversing roller and serves to prevent the liquid from running off the lateral edge portions and into the machine.

The liquid intercepting means need not necessarily prevent the liquid from running off the lateral edge portions per se, as long as it prevents the liquid from running into the machine by intercepting it in appropriate manner which will be described subsequently.

The references that are made herein to "fouling" of printing station components by the printing ink should not be considered to refer exclusively to the formation of encrustations or the like due to the drying of ink; it is evident that the term will also apply in circumstances where it is desired to switch from printing with one ink color to printing with another ink color, in which case the components that are smeared with ink of the undesired previous color are, of course, to be considered as "fouled" thereby.

The novel features which are considered as characteristic for the invention are set forth in particular in the appended claims. The invention itself, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
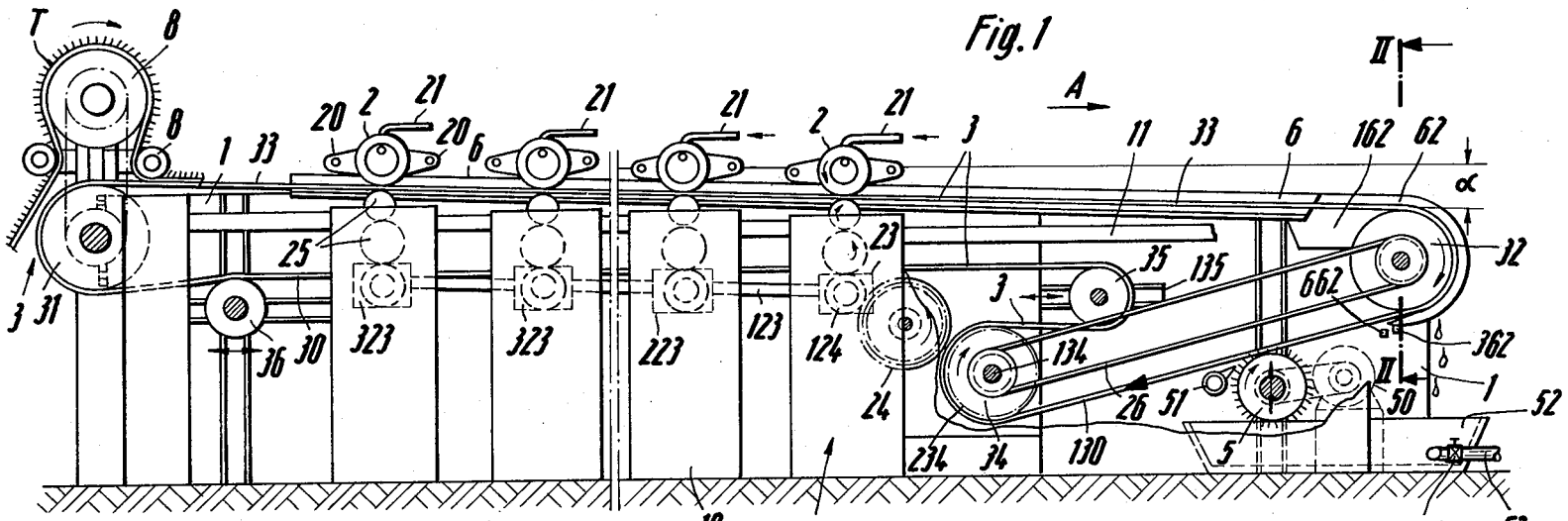
FIG. 1 is a diagrammatic partly sectioned side view illustrating a printing machine embodying the invention.
Figure 2:
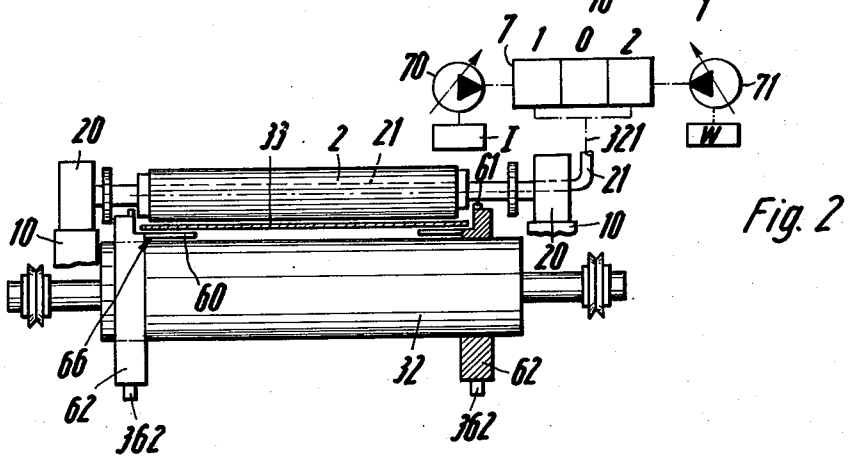
FIG. 2 is a section taken on line II—II of FIG. 1.
Figure 3:
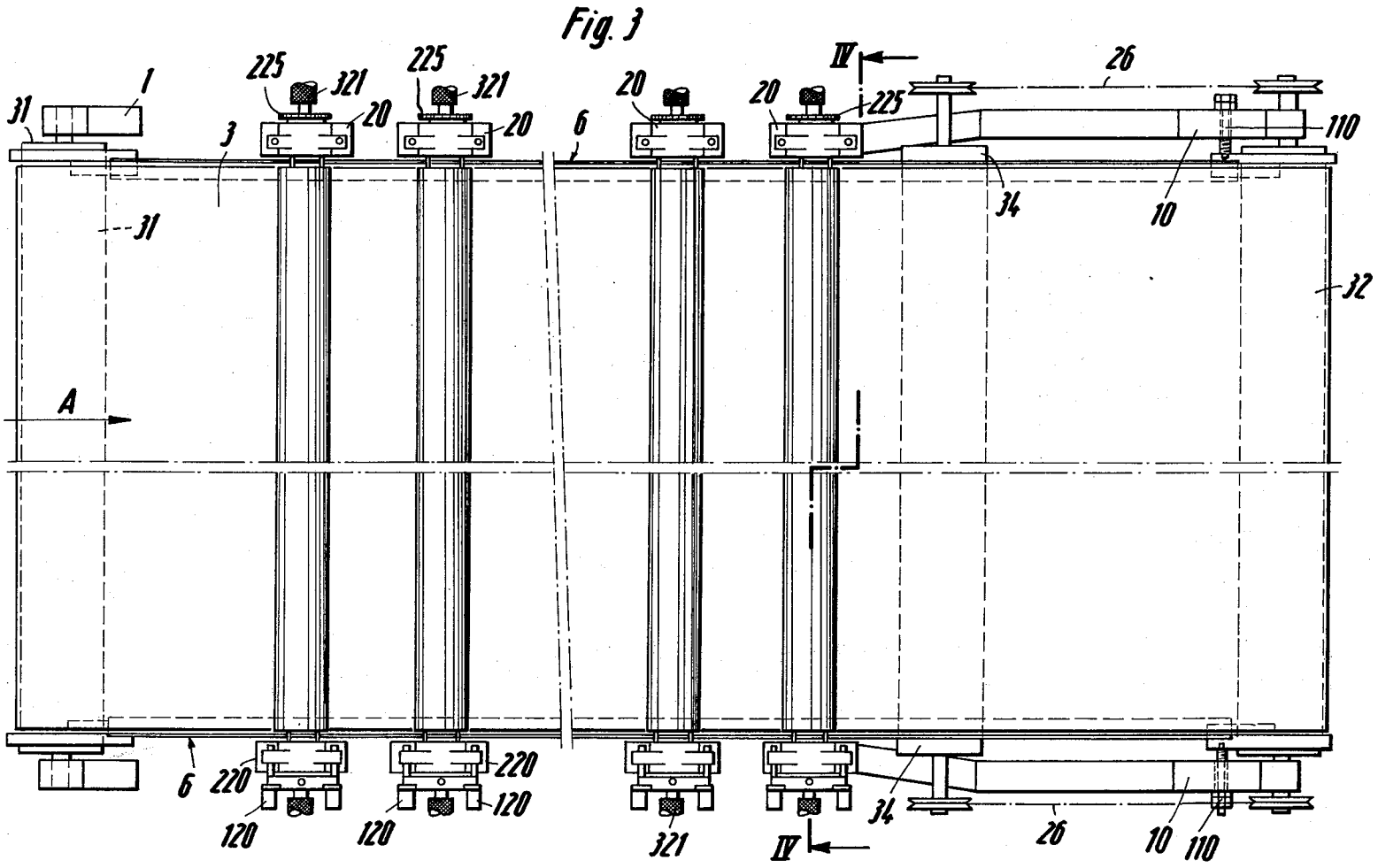
FIG. 3 is a top plan view of FIG. 1 with portions omitted for the sake of clarity and with illustration quite diagrammatic.

Referring now to the drawing in detail, and discussing firstly the embodiment that is illustrated in FIGS. 1–5, it will be seen that the printing machine illustrated in these Figures is a screen printing machine having tubular printing screens 2. However, it should be understood that the invention would also be applicable to flat printing screens of the type for instance disclosed in French patent 1,230,051, or indeed to other types of printing machines having in their single or several printing stations components which are required to be cleaned from time to time. Reference numeral 1 in FIGS. 1–5 identifies a machine frame composed of a plurality of uprights 10 located at the left-hand and right-hand sides of the machine and connected in their upper regions by longitudinal connecting members 11 (see FIG. 4). In the illustrated embodiment, a plurality of printing stations is provided, spaced lengthwise of the machine and each having a tubular printing screen 2 which is journalled at its opposite axial ends in bearings 20, 220 on the respective uprights 10. These printing screens 2 are mounted above an endless printing blanket 3 which is composed of or coated with elastomeric material, e.g., natural or synthethic rubber or synthetic plastic material. It is preferred that a special rubber or a special synthetic plastic material be used which has a low coefficient of friction, such as Teflon (TM) which is generally known as polytetrafluoroethylene.

The printing blanket 3 is not permeable to liquid and is trained about two reversing rollers 31 and 32 which are located at the opposite ends of the machine, that is at the left-hand intake end where the workpiece web T to be printed (e.g., a rug, carpeting or the like) is drawn into the machine by an intake device 8 to travel in the direction of the arrow A beneath the several printing screens 2 while being supported on the printing blanket 3, and a discharge end at the right-hand side of FIG. 1 where the printed workpiece web T is withdrawn in a manner not illustrated but conventional from the printing blanket 3. The printing blanket has an upper run 33 which is the one that actually supports the workpiece web T, and in accordance with the present invention the upper run 33 is downwardly inclined with reference to the horizontal by an angle $\alpha$ in direction towards the outlet end (compare FIG. 1). The angle $\alpha$ preferably amounts to about 15°, but could also be somewhat larger or smaller; it should not be as large as 20°. In the illustrated embodiment, the desired inclination of the upper run 33 of the printing blanket 3 is obtained by mounting the roller 33 for rotation in the direction indicated by the arrow on a shaft whose axis of rotation is located on a lower horizontal plane than the axis of rotation of the shaft about which the roller 31 rotates. However, it is evident that there are other ways in which the desired inclination could be accomplished.

Figure 5:
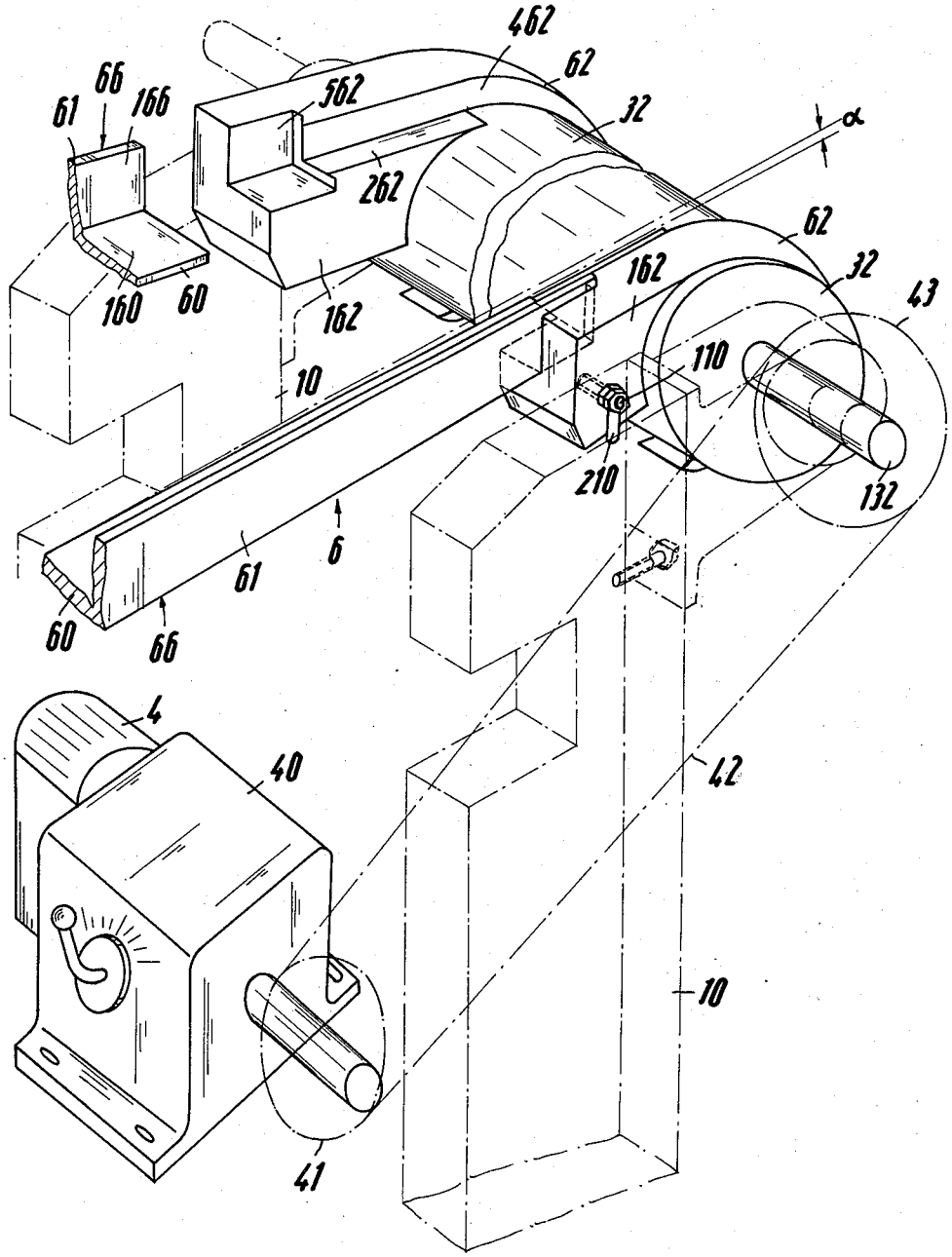
FIG. 5 is a partly sectioned somewhat diagrammatic perspective view illustrating a detail of FIGS. 1–4 on an enlarged scale.

The roller 33 is driven in rotation by a motor 4 via a continuously variable drive 40 (see FIG. 5). The drive 40 turns a sprocket 41 which rotates a sprocket 43 via a chain 42, and thus transmits rotary motion to the roller 32. This drive is most clearly shown in FIG. 5 wherein, however, the printing blanket 3 which is trained about and advanced by the roller 32, has been omitted for the sake of clarity of illustration. The upper run 33 of the printing blanket of course travels in the direction of the arrow A (FIG. 1).

After passing around the roller 32, the upper run of the printing blanket 3 turns into a lower run 30 which is trained about a roller 34 and a tensioning roller 35 that has its shaft shiftably mounted in the illustrated guide rail 135 (there will be one located at each end of the roller 35) and is biased towards the right by non-illustrated biasing means, so as to maintain the printing blanket in taut condition. From the roller 35 the printing blanket 3 travels over and in contact with a further tensioning roller 36 that is also spring biased and can perform movements as indicated by its associated double-headed arrow, and then is reversed about the roller 31.

The portion 130 of the lower run 30 of the printing blanket 3 has associated with it a washing arrangement to wash contaminants off the surface of the printing blanket 3, for example adhesives that may be used in conventional manner to fix the workpiece web T on the workpiece carrying surface of the printing blanket 3 so as to prevent shifting of the workpiece T relative to the printing blanket 3 as the web T passes through the several printing sections. Such contaminants are removed by the washing arrangement that is shown in FIG. 1 and which may utilize a known brush roller that is biased against the workpiece carrying surface of the portion 130 and is driven in rotation by the diagrammatically illustrated motor 50. Spray nozzles 51 may be associated with this arrangement to spray water or another cleaning liquid against the surface of the portion 130; water can be supplied to the nozzle 51 from any conventional water supply. A receptacle 52 is provided with is located not only beneath the roller 32 but also extends beneath the washer arrangement including the brush roller 5 and the nozzle 51, so that liquid therefrom will drip into this receptacle 52 to be collected therein. The receptacle 52 may have an outlet 53 through which accumulated liquid can be discharged; the outlet 53 may be controlled by a manually or automatically operated valve 153 which is shown diagrammatically The printing screens 2 of the several stations are driven in rotation, and motion is transmitted to them for this purpose from the roller 34. The latter is driven by the printing blanket which is trained about it, and also is additionally driven in that it is connected via a chain drive with the drive roller 32. The roller 34 has a shaft 134 on which a gear 234 is mounted which meshes with a gear 24 and drives via the same a gear 124 (there may, of course, be more or fewer such gears provided). In any case, the final gear of this series, here the gear 124, drives an angle drive 23 which, in turn, rotates a main drive shaft 123 of the machine that acts upon additional angle drives 223, 323 each of which is associated with one of the tubular printing screens 2.

Each of the tubular printing screens 2 has a drive gear 225 (see FIG. 4) which receives motion via gears 25 and 125 and is mounted on a sleeve 325 which is journalled via bearings 425 in the journals 20 of the associated printing screen 2. This type of drive may be provided at the opposite axial ends of each of the printing screens 2, but could also be provided at only one of these ends. At the axial end remote from the drive, if the drive is provided at only a single end, each printing screen has associated with it two fluid-operated tension cylinders 120 which pull the printing journal 220 in the direction of the arrow B, to thereby maintain the very thin and flexible metal of the printing screen 2 in tensioned condition. The bearing 220 also accommodates a sleeve 325 that is mounted via antifriction bearings 425. A main gear 423 may be arranged between the gears 25, 125 and the respective angle drive 23, as shown in FIG. 4.

Figure 4:
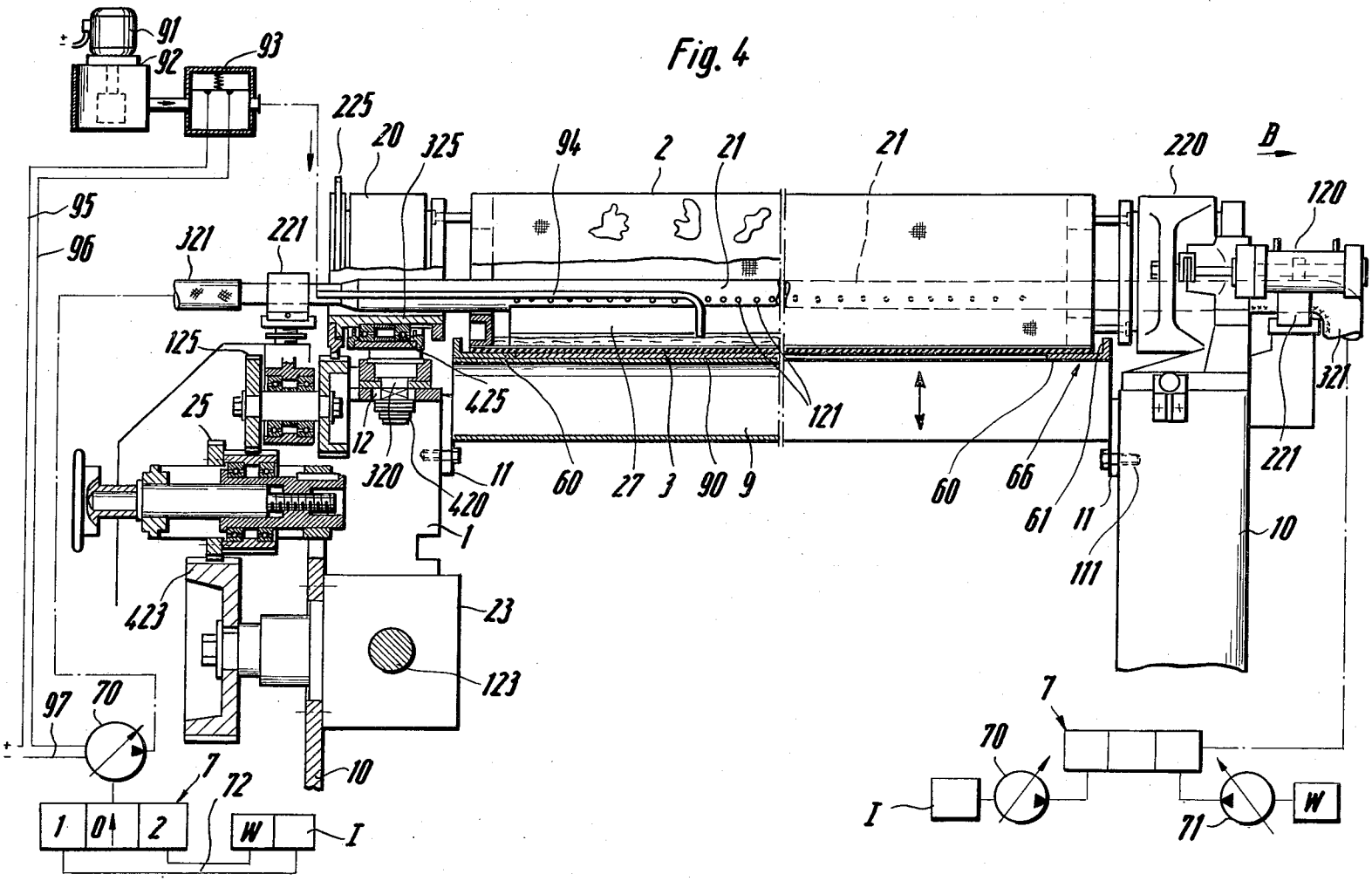
FIG. 4 is a section on line IV—IV of FIG. 3 and illustrating certain components that are shown in FIG. 3.

The bearings 20, 220 of each printing screen 2 are adjustable as is indicated in FIG. 4 where it will be seen that a pin 320 can be raised or lowered by means of bolts or screws 420. The upper end of the pin 320 supports the journal 20 which surrounds the sleeve 325, and the pin 320 is adjustable in a slot-shaped opening 12 of the machine frame 1. Thus, the journals 20 can be raised or lowered.

In the illustrated embodiment, each of the tubular printing screens 2 has an ink duct 21 extending axially through it; this ink duct 21 is provided with outlet openings or nozzles 121 through which printing ink is discharged for engagement by the squeegee 27 which may be fixedly mounted so that the printing screen 2 rotates with reference to it, or may be of the cylindrical rotary type. In any case, the squeegee 27 presses the printing ink through the perforations of a tubular printing screen 2 and onto the workpiece web T so as to print a desired pattern or the like onto the web T. The printing blanket 3 and the workpiece web T are supported against downward yielding under the pressure exerted by the respective tubular printing screens 2 by the presence of a pressure beam 9 that is mounted on the machine frame 1 beneath the printing blanket 3. It will be understood from FIG. 4 in particular that the counter-pressure beam 9 has an upper surface layer 90 on which the printing blanket slides, and that the workpiece web T will be supported on top of the printing blanket but has been omitted in FIG. 4 for the sake of clarity.

As has already been explained, the printing ink ducts 21 extend through the respectively associated printing screens 2 in axial direction thereof. Each of the ducts 21 is therefore supported in journals 221 adjacent the opposite axial ends of the respective tubular printing screens 2, and each duct 21 is connected with hoses 321 which lead to a single pump 70 (shown at the left side in FIG. 4) or optionally to a dual pump arrangement having pumps 70 and 71 (shown at the right side of FIG. 4). The pump 70, shown for example in FIG. 2, pumps printing ink from the printing ink source I into the printing ink duct 21.

When it becomes necessary from time to time to clean the printing ink from the printing screen 2, the squeegee 27 and the other associated components, for example when the machine is to be switched over from printing with one color to printing with another color, the supply of printing ink to the respective duct 21 will be terminated and instead a cleaning liquid will now be admitted via the duct 21. For this purpose, a switching valve 7 is provided having three positions identified with the characters 0, 1 and 2, respectively. In the position 0 the valve 7 does not permit any liquid to pass to the pump 70. When the valve 7 is in the position 1 the pump is connected via a fluid line 72 with the ink source I, and when flushing is desired the valve 7 is moved to the position 2 in which it connects the pump 70 via a further fluid line 72 with a water supply source W. Evidently, instead of water this could be a different cleaning liquid. Valves 7 are shown only diagrammatically because they are entirely conventional as to their construction and operation and are commercially available.

When the respective printing stations are to be cleaned, the feeding of workpiece web T will be discontinued and the valve 7 be placed into its position 2 so that the pump 70 now draws cleaning liquid (e.g., water) from the source W and supplies it via the hose 321 into the associated printing ink duct 21 from where it runs out through the outlet openings 121 into the interior of the printing screen 2. It flushes away any ink residue in the printing screen 2 and that may adhere to the squeegee 27, and runs off through the perforations of the printing screen 2 and onto the upper run 33 of the printing blanket 3 where it now travels towards the right in FIG. 1 that is towards the reversing roller 32. FIG. 4 shows diagrammatically that two pumps 70, 71 could be provided of which one would always supply printing ink from the source I and the other would always supply cleaning liquid from the source W, but in this case also the valve 7 would be provided and the operation would be the same as has just been described, except that two pumps would be used instead of one.

If the printing stations are of a different type than illustrated in the drawing, for example if they do not use tubular printing screens 2 with ink supply ducts 21, then it would be possible to spray cleaning liquid from the exterior against the components to be cleaned, for example by means of a hose. This would be more complicated that the arrangement that has just been described, but it will be understood that it would be within the intent of the invention since the hose and the source W in this case also would constitute a cleaning means in the sense in which the term is employed herein.

The cleaning liquid, which carries with it the residual ink that has been flushed off the components of the respective printing station, must not be allowed to run off the lateral sides of the printing blanket 3 and enter into the machine. Instead, it must be forced to travel lengthwise of the upper run of the printing blanket 3, in the manner that is intended by inclining the upper run 33 to the horizontal at the angle, $\alpha$, so that the liquid can then be collected in the receptacle 52 or in some other device having an analogous purpose.

To prevent this lateral escape of liquid and entry thereof into the machine, the upper run 33 of the printing blanket 3 has associated with it liquid intercepting means which extends at least from the printing stations to the region of the reversing roller 32 along the lateral edge portions of the upper run 33. This liquid intercepting means is generally identified with reference numeral 6, 6′ or 6″ throughout the several embodiments.

In the embodiment of FIGS. 1–5, the liquid intercepting means 6 utilizes angle rails 66 each of which has one horizontal arm 60 that extends from beneath under the lateral edge portion of the upper run 33 of the printing blanket, and an upright arm 61 that is located laterally adjacent this edge portion and prevents running off of the liquid. The horizontal arms are advantageously wider than the upright arms, so that enough of an overlap exists between them and the upper run 33 to properly prevent run off. The upper run 33 is, of course, in sliding contact with the upper surfaces of the arms 60. Between themselve, the arms 60 leave sufficient room for the counter-pressure beam 9, or rather the upper layer 90 thereof, shown in FIG. 4.

The upright arms 61 are located closely adjacent edges of the upper run 33 of the printing blanket 3, thus having the additional purpose of serving as a guide for the printing blanket in the event that the latter should tend to shift laterally in one or the other direction. These lateral edges of the upper run 33 should be located closely adjacent to the upright arms 61 (this has not been illustrated for the sake of clarity), but there must not be any friction between them that could lead to damage or destruction of the edge of the upper run 33. The upper must pass in contact with the rails 66 with a little friction as possible, which is why it is preferably made of the special low friction material mentioned earlier.

The rails 66 extend to and cooperate with end sealing members 62 which may be of synthetic plastic material (e.g., Teflon (TM) or metal (e.g., stainless steel). These are pushed from opposite axial ends onto the roller 32 which they surround with play so that there is no friction between them and the roller. The end sealing members 62 each embrace the roller 32 over at least 180° of its circumference and are each formed with an extension 162 having a recess 562 in which an end portion of the respective angle rail 66 is received. The dimensions of the recess 562 are such that the surface 166 of the rail arm 61 and the surface 462 of the respective end seal member 62 will be located in a common plane, and the surface 160 of the rail arm 60 and the surface 262 of the end seal member 62 will also be located in a common plane, when the end portion of the rail 66 is received in the respective recess 562. The purpose is to avoid any steps or uneveness over which the upper run 33 of the printing blanket 3 might otherwise have to slide and where it might become damaged.

The cleaning liquid thus runs along the upper run 33 and over the roller 32, to drip into the receptacle 52, as shown in FIG. 1.

Figure 6:
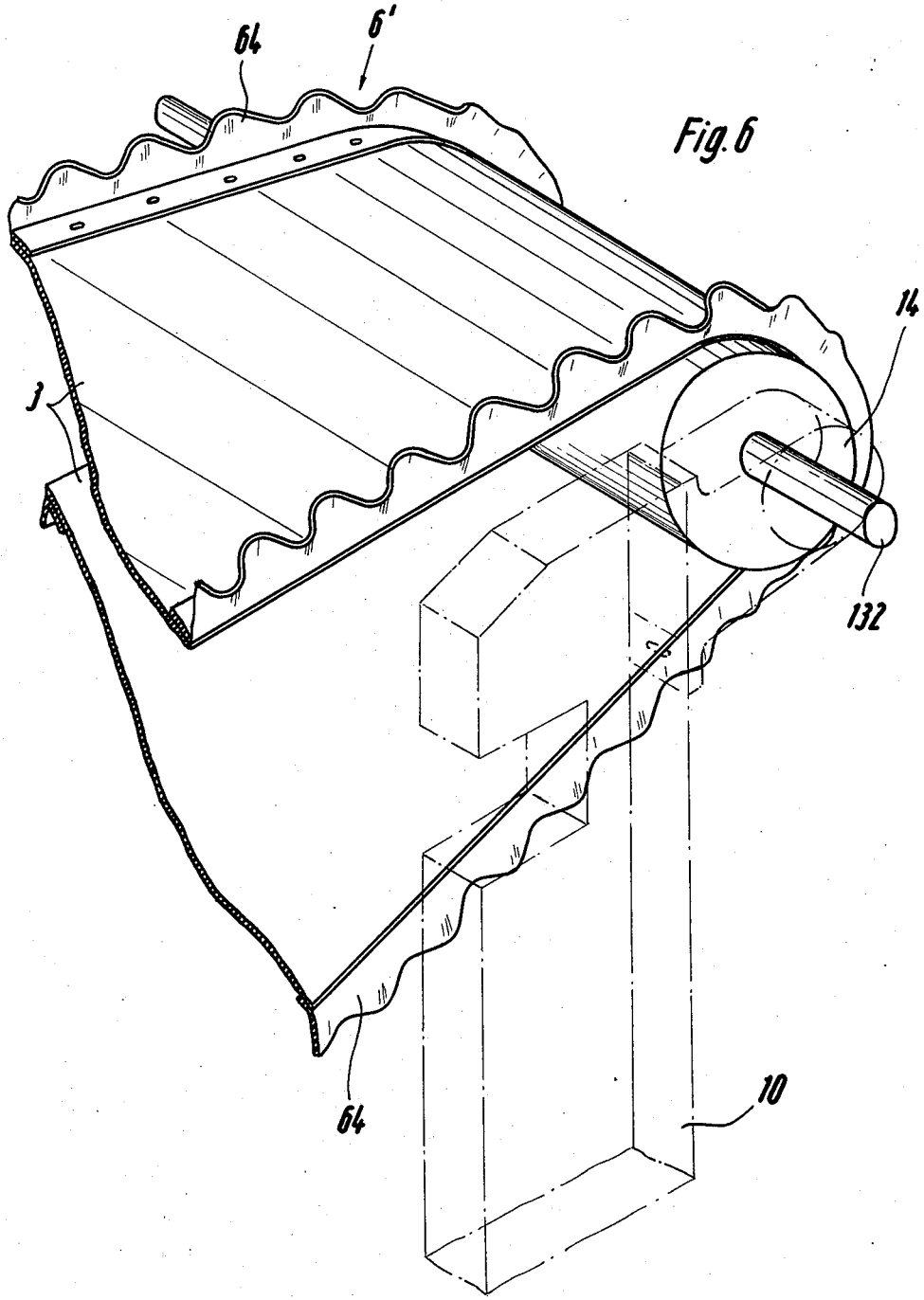
FIG. 6 is a view similar to FIG. 5 illustrating a detail of a different embodiment which can be used in the overall organization of the printing machine shown in FIGS. 1–4.

The embodiment in FIG. 6 differs somewhat from that shown in FIG. 5, but it should be understood that this embodiment can be used in the overall organization of the machine as shown in FIGS. 1–4 (or in any machine that has been described as analogous thereto) in lieu of the embodiment shown in FIG. 5.

In FIG. 6, the printing blanket 3 is provided with liquid intercepting means 6' in form of continuous edge strips 64 which extend all along the upper and lower runs of the printing blanket 3. These edge strips may be rubber or synthetic plastic material and have a horizontal arm that is secured to the lateral edge portions of the printing blanket 3, by vulcanizing, by adhesive means or in any other suitable manner so that the edge strips 64 travel with the moving printing blanket 3. The upstanding arms of the edge strips 64 are corrugated and the corrugations are somewhat inclined so that in the region of their free edges or second margins the strips 64 have less resistance to flexing than in the region of their first edges or first margins that are connected to the printing blanket 3, thus making it possible for the edge strips 64 to travel around the roller 32 without becoming completely flattened out. The edge strips 64 can be used by themselves as shown in FIG. 6, or they can be used in addition to the rails 66 and end sealing members 62 that were shown in FIG. 5.

Figure 7:
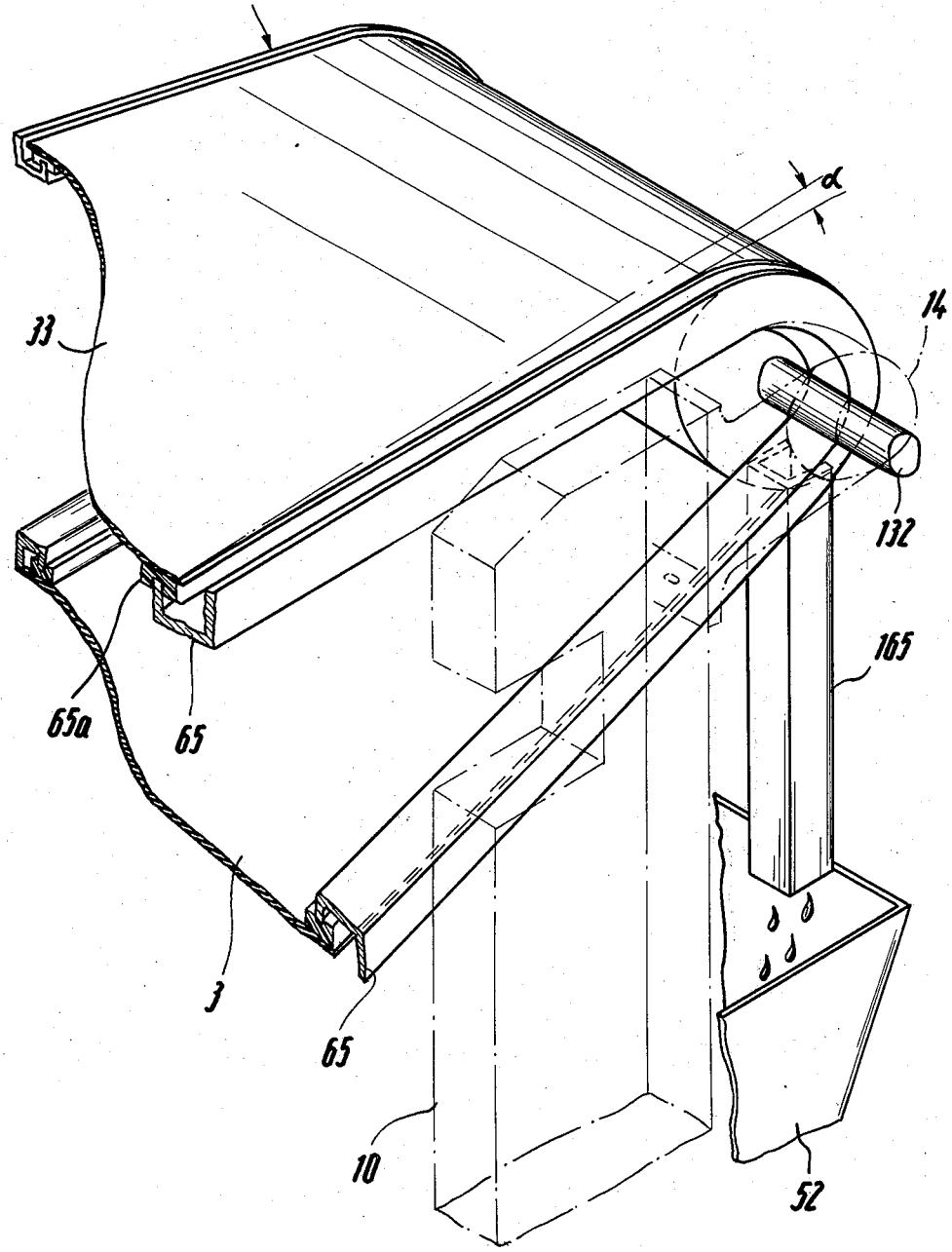
FIG. 7 is a view similar to FIG. 6 illustrating a detail of a further embodiment that can be used in the overall organization of a printing screen such as is shown in FIGS. 1–4.

FIG. 7 shows still another embodiment that the one in FIG. 5, which can also be used in the organization of FIGS. 1–4 (or in a machine that has been identified as analogous thereto) in lieu of the embodiments in FIGS. 5 and 6.

In FIG. 7 the liquid intercepting means 6'' utilizes U-profiled rails 65 whose open side faces upwardly to form a trough. The inner arm of each rail 65 is located inwardly of and beneath the respective lateral edge of the upper run 33, where it may extend into a slot of a guide strip **65*a* that may be bonded or otherwise secured to the underside of the printing blanket 3 to travel with the same, so that the rails 65 also serve as a guide for the printing blanket 3 to prevent its lateral shifting. Of course, one of these strips 65*a* in cooperation with one of the rails 65** would achieve the intended purpose, but it is possible to provide them on both lateral sides of the printing blanket.

The outer upright arm of the respective rail 65 is laterally spaced from the free edge of the upper run 33 so that liquid that runs off the same will enter into the trough formed by the respective rail 65. The rails 65 are shaped so as to extend around the roller 33 which is journalled in the diagrammatically illustrated support 14 that surrounds the shaft 132 of the roller and is mounted on a respective upright 10. The rails 65 may extend close to the floor of the machine with their free ends (as shown in FIG. 7) and/or a vertical rail portion 165 may be provided through which the liquid that runs off will drip into the receptacle 52 as shown. The rails 65 may be mounted in the same manner as the rails 66 of FIG. 5 insofar as their mounting in the machine is concerned.

All of the rails 65, 66 are advantageously mounted as to be adjustable. They are supported by the counter-pressure beam 9 and the latter is adjustable so that this results in an inherent adjustment of the rails 65, 66. The counter-pressure beam 9 is mounted on the longitudinal connecting members 11 of the frame, and these, in turn, are mounted on the uprights 10 with reference to which they can be adjusted by tightening or loosening of screws 111 which extend through vertical slots in members 11 into bores in uprights 10. The end sealing members 62 can be adjusted by means of screw 110 (compare FIG. 5) which extend through slot-shaped holes 210 of the uprights 10 or the frame 1. This possibility of adjusting avoids friction between the end sealing means 62 and the roller 32 since the end sealing members 62 can be moved to a position in which not such friction exits.

It is clear that various modifications are possible to those having skill in the art, and will offer themselves to such persons. For example, to prevent the end sealing members 62 from rotating with the roller 32 if they should come into direct contact therewith, they may be provided with abutments 362 (FIG. 1) which engage cooperating abutments 662 that are provided fixedly on the machine frame 1. Other types of abutments besides the abutments 662 could be utilized, for instance a traverse member. It will be clear from the drawing that the device 8 is also given by the motor 4 which drives the printing blanket 3.

FIG. 4 shows an arrangement for controlling the level of liquid in the tubular printing screens 2 either of ink or of cleaning liquid. It utilizes a motor 91 which operates a blower 92 from which air is blown via a diaphragm switch 93 (i.e., a transducer) into a tube 94 which extends into the interior of the respective tubular printing screen 2 and has a downwardly directed outlet. The switch 93 is connected with the pump motor 70 via electric lines 95 and 96, shown at the left-hand side of FIG. 4, and immediately stops operation of the pump 70 when a pressure increase occures in the tube 94 due to a rise of the level of liquid within the tubular printing screen to such an extent that the liquid level closes the outlet end of the tube 94. When this takes place the switch 93 responds to the pressure increase and interrupts the supply of electric energy via the line 97 to the pump 70.

It is, of course, not necessary that the receptacle 52 serve both to collect the liquid from the cleaning arrangement and the liquid from the washing arrangement utilizing the brush roller 5. Separate receptacles could be employed if desired.

The present invention makes it possible to clean an entire large printing machine in the space of only a few minutes of the color printing ink that has just been utilized and to make it ready for the use of a different color printing ink. This is, of course, accomplished without having to disassemble any part of the machine and requires merely an interruption of the feed of the web T for a few minutes and an interruption of the feeding of the printing ink for the same period of time, while the machine is being cleaned with the cleaning arrangement according to the present invention.

It will be understood that each of the elements described above, or two or more together, may also find a useful application in other types of constructions differing from the type described above.

While the invention has been illustrated and described as embodied in a printing machine having a cleaning function, it is not intended to be limited to the details shown since various modifications and structural changes may be made without departing in any way from the spirit of the present invention.

Without further analysis, the foregoing will so fully reveal the gist of the present invention that others can be applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a printing machine, particularly in a screen printing machine, a combination comprising a printing station having components which require intermittent cleaning due to fooling by the printing ink; an endless driven printing blanket trained about a first and a second reversing roller which are spaced lengthwise of the machine from said printing station, in upstream and downstream direction, respectively, said printing blanket having an upper run extending beneath said printing station and carrying the workpiece to be printed, and said upper run being inclined downwardly with respect to the horizontal from substantially said first reversing roller to said second reversing roller; cleaning means upwardly of said upper run for at times discharging a cleaning liquid into said printing station to clean said components and run off onto said upper run of said printing blanket; and liquid intercepting means extending along the respective lateral edge portions of said upper run at least intermediate said printing station and said second reversing roller, so that cleaning liquid which is discharged into said printing station and runs off onto said upper run will be confined thereon by said liquid intercepting means and be constrained to run off in a predetermined direction due to the inclination of said upper run.

2. A combination as defined in claim 1 wherein said upper run has a workpiece intake end and also has a workpiece outlet end adjacent said second reversing roller.

3. A combination as defined in claim 1, said printing blanket also having a lower reversing run; further comprising means for washing said lower reversing run; and a receptacle positioned to receive the liquid running off from both of said runs.

4. A combination as defined in claim 1, wherein the angle of inclination of said upper run with respect to the horizontal is smaller than 20°.

5. A combination as defined in claim 1, wherein said upper run has a workpiece intake end and a workpiece outlet end, said second reversing roller being located at said outlet end; and further comprising an additional reversing roller located at said intake end at a level higher than said second reversing roller to provide said downward inclination.

6. A combination as defined in claim 1, said intercepting means comprising rails having an upwardly open substantially U-shaped profile bounded by an inner upright arm located beneath a respective one of said lateral edge portions and an outer upright arm outwardly spaced from said respective lateral edge portion.

7. A combination as defined in claim 6, wherein said printing blanket is composed of liquid-impermeable material.

8. A combination as defined in claim 1; further comprising an ink supply duct for supplying ink to said printing station; and wherein said cleaning means is operative for at times supplying cleaning liquid into said ink supply duct in lieu of the ink therein.

9. A combination as defined in claim 8, wherein one of said components is a tubular rotatable printing screen, and said ink supply duct extends axially through said printing screen.

10. A combination as defined in claim 8, further comprising a source of ink and a source of cleaning liquid; and wherein said cleaning means comprises valve means and conduit means for selectively connecting said ink supply duct with one or with the other of said sources.

11. A combination as defined in claim 1, wherein said intercepting means comprises edge strips mounted on and extending along said printing blanket for travel with the same, said edge strips projecting beyond the plane of a workpiece-supporting surface of said printing blanket.

12. A combination as defined in claim 11, wherein said edge strips are corrugated.

13. A combination as defined in claim 11, wherein said edge strips each have a first margin at said workpiece-supporting surface of said printing blanket, and a free second margin spaced from said plane of said workpiece-supporting surface, said edge strips being formed with inclined corrugations so as to have the ability to yield at said second margin.

14. A combination as defined in claim 11, wherein said edge strips are of elastomeric material.

15. A combination as defined in claim 14, wherein said elastomeric material is rubber.

16. A combination as defined in claim 14, wherein said elastomeric material is synthetic plastic material.

17. A combination as defined in claim 1, said intercepting means comprising angle rails located at said lateral edge portions and each having a horizontal arm projecting beneath one of said edge portions and an upright arm projecting upwardly beyond said one edge portion, said angle rails extending toward said second reversing roller and said lateral edge portions being a sliding engagement with said horizontal arms.

18. A combination as defined in claim 17, wherein said intercepting means further comprises end sealing members provided at second reversing roller and engaging the respective angle rails.

19. A combination as defined in claim 18, said end sealing members being located at opposite axial ends of said second reversing roller and embracing the same over a substantial portion of its circumference.

20. A combination as defined in claim 18, wherein said end sealing members are of a synthetic plastic material having a low coefficient of friction.

21. A combination as defined in claim 18, wherein said angle rails are of a material having a low coefficient of friction.

22. A combination as defined in claim 18, wherein said end sealing members are composed of stainless steel.

23. In a printing machine, particularly in a screen printing machine, a combination comprising a printing station having components which require intermittent cleaning due to fouling by the printing ink; an endless driven printing blanket trained about a reversing roller which is spaced lengthwise of the machine from said printing station, said printing blanket having an upper run extending beneath said printing station and carrying the workpiece to be printed, and said upper run being inclined downwardly with respect to the horizontal in direction from said printing station towards said reversing roller; cleaning means upwardly of said upper run for at times discharging a cleaning liquid into said printing station to clean said components and run off onto said upper run of said printing blanket; and liquid intercepting means extending along the respective lateral edge portions of said upper run at least intermediate said printing station and said reversing roller, for preventing the liquid from running off said lateral edge portions into the machine, said intercepting means comprising angle rails located at said lateral edge portions and each having a horizontal arm projecting beneath one of said edge portions and an upright arm projecting upwardly beyond said one edge portion, said angle rails extending toward said reversing roller and said lateral edge portions being in sliding engagement with said horizontal arms, and end sealing members provided at said reversing roller and engaging the respective angle rails, said end sealing members being non-rotatably mounted and said reversing roller having freedom of rotation relative to them.

24. A combination as defined in claim 23, said machine including a support structure; and further comprising cooperating abutments on said support structure and on said end sealing members for preventing the latter from rotating with said reversing roller.

25. In a printing machine, particularly in a screen printing machine, a combination comprising a printing station having components which require intermittent cleaning due to fouling by the printing ink; an endless driven printing blanket trained about a reversing roller which is spaced lengthwise of the machine from said printing station, said printing blanket having an upper run extending beneath said printing station and carrying the workpiece to be printed, and said upper run being inclined downwardly with respect to the horizontal in direction from said printing station towards said reversing roller; cleaning means upwardly of said upper run for at times discharging a cleaning liquid into said printing station to clean said components and run off onto said upper run of said printing blanket; liquid intercepting means extending along the respective lateral edge portions of said upper run at least intermediate said printing station and said reversing roller, for preventing the liquid from running off said lateral edge portions into the machine, said intercepting means comprising rails having an upwardly open substantially U-shaped profile bounded by an inner upright arm located beneath a respective one of said lateral edge portions and an outer upright arm outwardly spaced from said respective lateral edge portion; and a guide strip mounted on one of said lateral edge portions and engaging the associated inner upright arm for preventing lateral displacement of said upper run relative to said rails.

26. In a printing machine, particularly in a screen printing machine, a combination comprising a printing station having components which require intermittent cleaning due to fouling by the printing ink; an endless driven printing blanket trained about a reversing roller which is spaced lengthwise of the machine from said printing station, said printing blanket having an upper run extending beneath said printing station and carrying the workpiece to be printed, and said upper run being inclined downwardly with respect to the horizontal in direction from said printing station towards said reversing roller; cleaning means upwardly of said upper run for at times discharging a cleaning liquid into said printing station to clean said components and run off onto said upper run of said printing blanket; liquid intercepting means extending along the respective lateral edge portions of said upper run at least intermediate said printing station and said reversing roller, for preventing the liquid from running off said lateral edge portions into the machine, said intercepting means comprising rails having an upwardly open substantially U-shaped profile bounded by an inner upright arm located beneath a respective one of said lateral edge portions and an outer upright arm outwardly spaced from said respective lateral edge portion, said rails having rail parts which at least partly encircle respective axial end regions of said reversing roller and are formed with downwardly directed outlet ends.

27. A combination as defined in claim 26; and further comprising a receptacle positioned to receive liquid running off from said outlet ends.

28. In a printing machine, particularly in a screen printing machine, a combination comprising a printing station having components which require intermittent cleaning due to fouling by the printing ink; an endless driven printing blanket trained about a reversing roller which is spaced lengthwise of the machine from said printing station, said printing blanket having an upper run extending beneath said printing station and carrying the workpiece to be printed, and said upper run being inclined downwardly with respect to the horizontal in direction from said printing station towards said reversing roller; cleaning means upwardly of said upper run for at times discharging a cleaning liquid into said printing station to clean said components and run off onto said upper run of said printing blanket; and liquid intercepting means extending along the respective lateral edge portions of said upper run at least intermediate said printing station and said reversing roller, for preventing the liquid from running off said lateral edge portions into the machine, said intercepting means comprising angle rails located at said lateral edge portions and each having a horizontal arm projecting beneath one of said edge portions and an upright arm projecting upwardly beyond said one edge portion, said angle rails extending toward said reversing roller and said lateral edge portions being in sliding engagement with said horizontal arms, and end sealing members providing at said reversing roller and engaging the respective angle rails, said end sealing member being located at opposite axial ends of said reversing roller, embracing the same over a substantial portion of its circumference and each having an extension projecting towards said printing station and bounded by a recess dimensioned to matingly receive an end portion of one of said angle rails, so that an upwardly directed surface of the horizontal arm and an inwardly directed surface of the upright arm of the associated rail are flush with corresponding surfaces of said extension.

* * * * *